United States Patent [19]

Burrell

[11] Patent Number: 4,519,220

[45] Date of Patent: May 28, 1985

[54] INTERCHANGEABLE JEWELRY HAVING SECURING MEANS

[76] Inventor: Lynn M. Burrell, 36 Harvard Ct., White Plains, N.Y. 10605

[21] Appl. No.: 468,071

[22] Filed: Feb. 22, 1983

[51] Int. Cl.[3] ..... A44C 17/02

[52] U.S. Cl. ..... 63/29 R; 63/23; 411/303

[58] Field of Search ..... 63/29 R, 20, 23; 411/301, 302, 303, 304, 907, 908

[56] References Cited

U.S. PATENT DOCUMENTS

| | | | |
|---|---|---|---|
| 131,945 | 10/1872 | Dunlap | 411/301 |
| 262,193 | 8/1882 | Wootten | 411/301 |
| 569,100 | 10/1896 | Gunther | 63/23 |
| 1,550,282 | 8/1925 | Rennerfelt | 411/303 |
| 2,220,038 | 10/1940 | Kreisler et al. | 63/23 |
| 2,390,759 | 12/1945 | Warren | 411/301 |
| 2,437,843 | 3/1948 | Van Ness | 411/301 X |
| 2,519,152 | 8/1950 | Piotrowski | 63/29 R |
| 2,908,309 | 10/1959 | Brill | 411/301 |
| 2,928,445 | 3/1960 | Van Buren | 411/303 |
| 3,004,574 | 10/1961 | Flick et al. | 411/301 |
| 4,353,225 | 10/1982 | Rogers | 63/29 R |

FOREIGN PATENT DOCUMENTS

| | | | |
|---|---|---|---|
| 102576 | 9/1941 | Sweden | 411/265 |
| 10490 | of 1914 | United Kingdom | 63/29 R |
| 1211829 | 11/1970 | United Kingdom | 63/29 R |

*Primary Examiner*—F. Barry Shay

[57] ABSTRACT

A simple to use, durable and effective securing means for an interchangeable wearable jewelry item having a base unit and a feature unit is described. The securing means includes a receiving structure being provided with a resilient insert and being contained within the base unit, the resilient insert being provided with a threaded, and essentially tapered hole having a wider opening at one end and a narrower opposite end; and a threaded stem having one end for setting the feature unit, and the opposite end for frictionally engaging the receiving structure by way of the tapered hole. The threaded stem structure could be securely engaged to the receiving structure by urging the threaded stem through the wider opening of the tapered hole, and adjusting the threaded stem further into the narrower end of the tapered hole thereby more frictionally engaging the receiving structure, or the threaded stem could also be disengaged from the receiving structure by adjusting the threaded stem in the reverse direction, whereby the feature unit could be mounted securely on the base unit, or disengaged from the base unit and selectively mounted securely on a different base unit having also such a receiving structure. By having a set of different feature units and another set of base units, each unit of both sets being provided with the securing means, many desirable combinations of the jewelry having entirely different appearances can be obtained for wearing as the user's taste changes, or for wearing on different occasions.

6 Claims, 8 Drawing Figures

INTERCHANGEABLE JEWELRY HAVING SECURING MEANS

DESCRIPTION

1. Technical Field

This invention relates generally to an ornamental article, and more particularly to an interchangeable jewelry item having securing means.

2. Background Art

Multi-use, or convertible jewelry items having detachable sections are well known in the art. An interchangeable jewelry item wherein a certain feature, usually the main or most valuable element of the jewelry item, can be changed from one form of base mounting to another is also known to some heretofore. This type of interchangeable jewelry permits the use of a single, valuable feature unit to be shared with a multiple number of different base mounting units whereby the appearance of the jewelry could be changed by the user to suit his or her desire for the moment, or for wearing on different occasions. The desirability, flexibility and associated cost advantages of interchangeable type of jewelry are also recognized and appreciated by some in the jewelry industry.

A significant drawback of interchangeable jewelry has been the less than ease of use, less than secure mounting of the valuable feature unit onto the base unit, and the resulting unfortunate inadvertent loss of the valuable feature unit during normal wearing. Accordingly, during the development of this art, a concern of critical importance has been the design of a satisfactory securing means for mounting such interchangeable feature unit on a base unit. The simplicity and ease of use of such securing means, small size and weight, aesthetic appeal, and safety from loss of the valuable feature unit are the most desirable design characteristics.

Some prior jewelry provide for such interchangeability of feature units, and the selective mounting of such a feature unit on a number of base units. For instance, U.S. Pat. No. 2,316,225 to E. S. De De Hoffman, et al discloses generally improvements for manufacturing ring-mounted jewelry. In one ring embodiment, it is described that an interchangeable stone or ornament may be mounted on a base, the lower part of which may have a threaded stem capable of being screwed into the interior of a regular threaded hole, and which hole being contained in the ring. There is not teaching of a tight fit, or securing means whereby inadvertent unscrewing can be prevented.

In another ring manufacturing embodiment by Hoffman, et al, it is shown that a stone is mounted on a supporting base plate having two projections, provided with resilient elements and of circular cross-section. The projections can be fitted inside and fixed by pressure within the interior of small cavities, formed in the body of the ring.

Some prior top settings for jewelry are provided with securing means. As an example, U.S. Pat. No. 1,160,723 issued to S. Lander discloses means for locking a setting after it is screwed in place, and thereby making it practically impossible to unscrew itself. According to the teaching, a semi-circular disk is attached to the head of the ring by means of a pin. After the top setting is screwed into the head of the ring, the semi-circular disk is moved in place with the threaded shank of the top setting, whereby the inner circumference of the disk will envelop the shank at the threaded groove thus locking the top setting in place. Also, in U.S. Pat. No. 1,166,431 issued to V. L. Capwell, a spring retained locking device is utilized to bite into the interior thread of a receiving orifice to secure the top setting from unscrewing.

Another interchangeable top setting for finger ring provided with securing means is described in U.S. Pat. No. 1,864,371 issued to G. Prussian. According to the invention, a stone is inserted among a set of spider arms which are drawn inwardly to hold the stone by means of a nut screwed on a threaded stem. After the nut has been screwed up to the desired extent, it is locked in place by turning the tongues, which are provided at the end of the threaded stem thereof, outwardly into notches provided for their reception in the surface of the nut.

Yet another interchangeable setting for stone is described in U.S. Pat. No. 529,184 issued to Z. A. Oppenheimer. According to the disclosure, two half-sections adapted to fit together and provided with a threaded shank section are used to embrace the stone. A threaded socket is adapted to receive the shank and to hold the two half-sections together thereby setting the stone. To form additional security, the setting can be secured to the socket by the use of a transverse pin extending through the socket and the shank.

The lack of a simple, durable, easy to use by the consumer, and yet effective securing means in the prior art for interchangeable jewelry, among other factors, has contributed not insignificantly to the unpopularity of such interchangeable jewelry notwithstanding the appreciation and recognition by some of the desirability, flexibility and associated low cost advantages of the same.

DISCLOSURE OF INVENTION

It is a principal object of the present invention to provide an easy to use securing means for an interchangeable ornamental article.

It is another principal object of the invention to provide an interchangeable ornamental article having securing means, wherein a feature unit could be mounted easily and securely on a base unit, or disengaged from the base unit and selective mounted securely on a different base unit.

It is also an object of the present invention to provide an interchangeable wearable jewelry having securing means, wherein a feature unit could be mounted easily and securely on a base unit, or disengaged from the base unit and selective mounted securely on a different base unit.

It is another object of the present invention to provide a low cost, easy to use securing means for an in interchangeable wearable jewelry.

It is yet another object of the present invention to provide a durable securing means for the safe interchangeability of different base units with different feature units in an interchangeable wearable jewelry item.

It is still another object of the present invention to provide a securing means for an interchangeable wearable jewelry which is easy to use, and which can be interchanged manually by an average consumer/user without the aid of any tool.

These and other objects of the present invention can be achieved by way of a securing means for an interchangeable ornamental article having a base unit and a feature unit, comprising: a resilient receiving structure being contained within the base unit, the receiving structure being provided with an essentially tapered hole having a wider opening at one end and a narrower opposite end; and a straight, untapered threaded stem structure having one end for setting the feature unit, and the opposite end of the threaded stem structure for frictionally engaging the receiving structure by way of the tapered hole. The threaded stem structure could be securely engaged to the receiving structure by urging the threaded stem structure through the wider opening of the tapered hole, and adjusting the threaded stem further into the narrower end of the tapered hole thereby more frictionally engaging the receiving structure. The threaded stem structure could be disengaged from the receiving structure through the wider opening by adjusting the threaded stem structure away from the narrower end of the tapered hole, whereby the feature unit could be mounted securely on the base unit, or disengaged from the base unit and selectively mounted securely on a different base unit having also such a receiving structure.

Alternatively, other objects of the present invention can be achieved by way of an interchangeable ornamental article comprising: a base unit containing a resilient receiving structure, the receiving structure being provided with an essentially tapered hole having a wider opening at one end and narrower opposite end; and a feature unit being set with a threaded stem for frictionally engaging the receiving structure by way of the tapered hole. The feature unit could be securely engaged to the receiving structure by urging the threaded stem through the wider opening of the tapered hole, and adjusting the threaded stem further into the narrower end of the taper hole, thereby more frictionally engaging the receiving structure. The feature unit could be disengaged from the base unit through the wider opening by adjusting the threaded stem away from the narrower end of the tapered hole, whereby the feature unit can be mounted securely on the base unit, or disengaged from the base unit and selectively mounted securely on a different base unit having also such a receiving structure.

BRIEF DESCRIPTION OF DRAWINGS

Details of the invention will be described in connection with the accompany drawings, in which.

BEST MODE FOR CARRYING OUT THE INVENTION

Figure 1A:
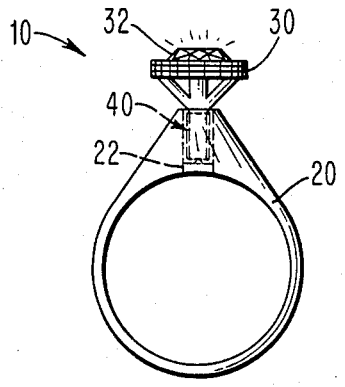
FIG. 1A is a diagram of a finger ring interchangeable wearable jewelry according to the present invention.
Figure 1B:
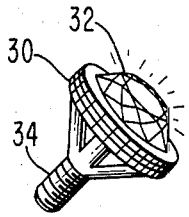
FIG. 1B is a perspective diagram of the gemstone feature unit of the interchangeable jewelry shown in FIG. 1A.

Referring to FIG. 1, and interchangeable jewelry 10 according to the preferred embodiment of the present invention includes a base unit 20 containing securing means 40, and a feature unit 30. The feature unit 30 usually, but not necessarily, is the most valuable component of the interchangeable jewelry 10. As used herein, the terms feature unit 30 and base unit 20 are merely exemplary, and are used to refer generally to any first ornamental part and a second ornamental part, respectively. More particularly, a feature unit could be referred to as a base unit 20, and a base unit could be referred to as a feature unit 30 without limiting the scope of the present invention.

Figure 2A:
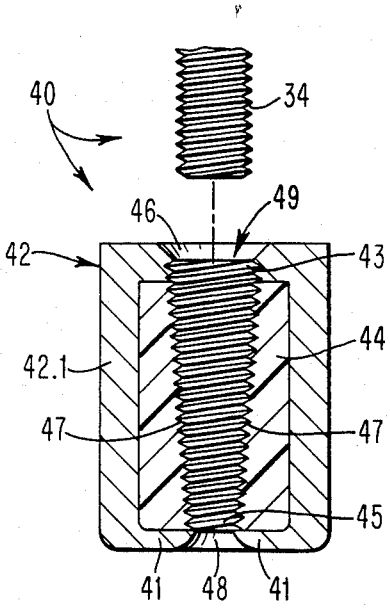
FIG. 2A is an expanded cross-sectional view of the securing means shown in FIG. 1A. A top view of the securing means is shown in FIG. 2B.
Figure 3A:
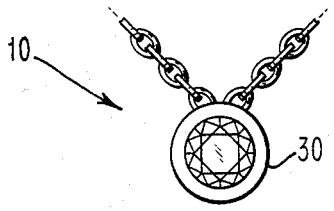
FIG. 3A is a front view showing the feature unit of FIG. 1B being mounted on a pendant, a different base unit in accordance with the present invention.
Figure 3B:
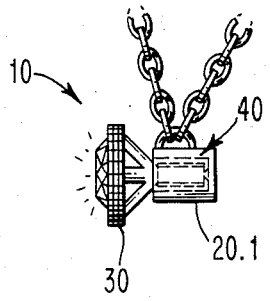
FIG. 3B is a side view showing the feature unit mounted on the pendant.
Figure 4A:
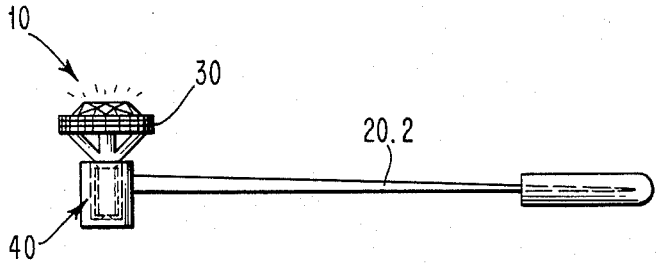
FIG. 4A is a side view showing the feature unit of FIG. 1B being mounted on a lapel pin, yet another base unit in accordance with the present invention.
Figure 4B:
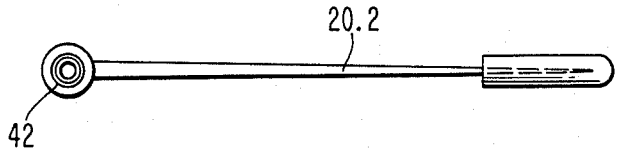
FIG. 4B is a front view of the lapel pin shown without the feature unit of FIG. 1B.

Feature unit 30 is provided with a longitudinally extending straight untapered threaded stem structure 34 at one end (as shown in FIG. 2A), and may, for instance, be set with a gemstone such as a diamond 32 at the other end. The feature unit 30 can be mounted easily and securely on the base unit 20 by way of the securing means 40, or can be disengaged from the base unit 20 and selectively mounted securely on a different base unit 20.1 and 20.2 (FIGS. 3 and 4). This type of interchangeable jewelry 10 allows the use of a single, valuable feature unit to be shared with a multiple number of different base mounting units 20.1, 20.2 whereby the appearance of the jewelry 10 could be changed by the user to reflect his or her desire at different times, or for wearing on different occasions. The securing means 40 according to the present invention is easy to use, and permits the quick manual interchangeability of feature unit 30 with base units 20, 20.1, 20.2 by an average consumer/user without the need or aid of any tool. The securing means 40 according to the present invention is simple to use, durable, and low cost in manufacturing, and is described next.

Figure 2B:
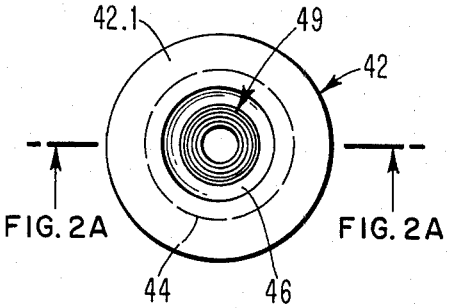

A preferred embodiment of the securing means 40 is shown in FIG. 2 in an expanded illustration. Securing means 40 according to the present invention may include a threaded stem structure 34 and a cylindrical receiving structure 42 havng an outer layer 42.1. Both the stem structure 34 and the outer layer 42.1 can be made of a durable hard metal, preferably made of non-tarnishing, high-temperature resistant metal such as platinum, stainless steel, titanium siladium (TM, a trademark owned by John Roberts Co., Texas), or a suitable hard gold alloy such as 10K gold. Such receiving structure 42 includes a beveled opening 46, preferably at an angle of about 45 degrees, at the top, and may also have a bottom opening 48. A resilient insert 44, preferably a durable resilient material such as Nylon (TM, a trademark of E. I. duPont deNemours & Co. Inc.), or Delrin (TM, a trademark of E.I. dePont deNemours & Co. Inc.) is placed in the interior of receiving structure 2. The insert 44 is provided with an essentially tapered hole 49 having a wider opening 43 at the top in substantial alignment with the beveled top opening 46, and a narrower opposite opening 45 aligned substantially with the bottom opening 48 (FIG. 2A). The insert 44 is preferably threaded on the side wall 47 of the tapered hole 49 thereof, an is of sufficient length so as to receive the straight threaded stem structure 34. It should be pointed out that while hole 49 is shown to be straightly tapered, this need not be so long as hole 49 is essentially tapered.

A typical dimension of the receiving structure 42 is about 0.156 in. long with a diameter of about 0.125 in., with the thickness of the metal layer 42.1 at about 0.0045 in., and the diameter of the tapered hole 49 about 0.086 in. at the wider opening end 43, and about 0.0625 in. at the narrower opening end 45. FIG. 2A is a grossly expanded illustration of the securing means 40 so as to show the details, and to facilitate an explanation of the preferred embodiment according to the present invention. The preferred embodiment can be made in many ways by one of ordinary skill in this art, once the invention features as described herein are disclosed. It is preferred that in the manufacturing of the preferred embodiment, a solid Nylon insert 44 be placed in the receiving structure 42, by way of the bottom opening 48, flush against the beveled top opening 46. The bottom metal edges 41 can then be rolled over to hold the Nylon insert 44 in place and to prevent its rotation during either a mounting or dismounting operation. The threaded tapered hole 49 may then be provided for by tapping the Nylon insert 44 via the beveled top opening 46. The finished receiving structure 42 is subsequently press-fit into a slightly smaller hole 22 (FIG. 1A), for instance with a hole diameter of about 0.1245 in., provided for in the base unit 20. The receiving structure 42 and the straight threaded stem structure 34, which has a diameter typically at about 0.086 in. and a stem length of about 0.156 in., together form the securing means 40, and are then ready to accommodate the quick and easy interchangeability of the feature unit 30 with base units 20, 20.1, 20.2. The securing means 40 as described hereinabove is small in size, light weight and durable. Since it is completely hidden, and out of sight, the securing means 40 according to the present invention does not impact or interfere with the aesthetic appearance design of the feature unit 30, or the jewelry 10 as a whole.

To securely mount the feature unit 30 onto the base unit 20, the user simply holds the gemstone 32 end of the feature unit 30 and screws the straight threaded stem structure 34 into the tapered hole 49 of the receiving structure 42, by way of the beveled top opening 46. By screwing the straight threaded stem structure 34 from the wider opening 43 to the narrower opening 45 of the tapered hole 49, the pressure created by the resilient insert 44 on the stem structure 34 increases proportionally as the stem structure 34 travels further towards the narrower end 45 of the tapered hole 49, thereby tightly engaging, by friction, the stem structure 34 to the receiving structure 42.

Likewise, to dismount the feature unit 30 from the base unit 20, the user again simply holds the gemstone 32 end of the feature unit 30 and unscrew the straight threaded stem structure 34 away from the tapered hole 49 of the receiving structure 42 by way of the beveled top opening 46. By unscrewing the stem structure 34 away from the narrower opening end 45 and towards the wider opening end 43 of the tapered hole 49, the pressure on stem structure 34 created by the resilient insert 44 decreases proportionally, thereby disengaging the stem structure 34 from the receiving structure 42 quickly and simply by hand and without the need or the aid of any tool.

Accordingly, by simply holding the feature unit 30 and twisting or untwisting, the feature unit 30 can be mounted securely on the base unit 20, or the feature unit 30 can be disengaged form the base unit 20 and selectively mounted securely on a different base unit 20.1, 20.2 having also such a receiving structure 42. For instance, as an illustration, the feature unit 30 including a diamond 32 could be mounted on finger ring 20 as shown in FIG. 1A. Alternatively, this interchangeable jewelry 10 according to the teaching of the present invention can take on a totally different appearance by mounting securely the diamond feature unit 30 on a pendant base unit 20.1 (FIGS. 3A and 3B), which is also provided with such receiving structure 42. Yet, the interchangeable jewelry 10 according to the teaching of the present invention, can take on another appearance, and so on, by mounting securely the diamond feature unit 30 on a lapel pin base unit 20.2 (FIGS. 4A and 4B), which is also provided with such receiving structure 42. Therefore, while the securing means 40 is surprisingly simple, it is both easy to use and effective in safeguarding against loss of the valuable feature unit 30.

Although the interchangeable jewelry 10 is shown to be provided with a single feature unit 30, it is clear that interchangeable jewelry 10 may have a multiple number of feature units 30. It should be noted that by having a set of different feature units and another set of different base units, each unit of both sets being provided with securing means 40 according to the teaching of the present invention, many different desirable combinations of jewelry having entirely different appearances can be obtained for wearing as the taste of the user changes, and for wearing on different occasions. Therefore, the desirability, flexibility, and associated cost advantages of interchangeable jewelry 10 are substantially enhanced by employing the securing means 40 in accordance with the teaching of the present invention.

While the receiving structure 42 and resilient insert 44 of the securing means 40 are shown and described to be of circular shape, they clearly need not be. Receiving structures 42 of other shapes are also possible, and may also be more desirable so as to prevent the rotation of the resilient insert 44 during a mounting or dismounting operation. Furthermore, although the receiving structure 42 is shown and described to include a metallic housing 42.1 and a resilient insert 44, other embodiments for the receiving structure 42 are also possible. For instance, the entire receiving structure 42 could be made of a resilient material. Even though the base unit 20 (also 20.1 and 20.2) is shown and described to be provided with a single receiving structure 42, such base unit 20 may include a multiple number of receiving structures 42 for mounting of a multiple number of feature units 30.

Although the tapered hole 49 of the securing means 40 is shown and described to be threaded. It is clear that the frictional engagement as a result of pressure created by the resilient insert 44 remains operative without the tapered hole 49 being threaded.

While the securing means 40 according to the present invention is shown and described for wearable interchangeable jewelry, the securing means 40 can be incorporated generally in other forms of interchangeable ornamental articles in a like manner in accordance with the teachings of the present invention.

From the preceding detailed description of Applicant's invention, it is seen that interchangeable ornamental articles 10 incorporating novel securing means 40 in accordance with the teachings of the present invention have advantages heretofore not possible to achieve. In addition to the variations and modifications of Applicant's disclosed apparatus, which have been suggested, many variations and modifications will be apparent to those skilled in the art, and accordingly, the scope of Applicant's invention is not to be limited to the particular embodiments shown or suggested.

Having thus described my invention, what I claim as new, and desired to secure by Letters Patent is:

1. An interchangeable wearable jewelry device comprising:

a base unit, said base unit having means for attachment of the device to a wearer and containing a receiving structure including a rigid outer member and a resilient non-metallic insert concealed and supported within said outer member, said receiving structure being provided with an essentially tapered threaded hole having a wider opening at one end thereof and tapering to a narrower opening at the opposite end; and a feature unit being set with a straight untapered rigid threaded stem structure, its thread being of a size to substantially mate with the thread of said receiving structure at the end of said tapered hole, the thread of said receiving structure being formed on the inner surface of said hole substantially from the wider opening and continuing to the narrower opening and being of sufficient length to contain the thread of said stem structure;

said feature unit being adapted to be securely engaged to said receiving structure by manually grasping said units, threading said threaded stem structure through the wider opening of said tapered hole, and adjusting said threaded stem structure further into the narrower end of said tapered hole, thereby more frictionally engaging said receiving structure;

said feature unit being adapted to be disengaged from said base unit through said wider opening by manually grasping said units and adjusting said threaded stem structure away from the narrower end of said tapered hole, whereby said feature unit can be mounted securely on said base unit, or disengaged from said base unit and selectively mounted securely on a different base unit having also such a receiving structure.

2. An interchangeable wearable jewelry as set forth in claim 1, wherein said receiving structure is made of non-tarnishing metal.

3. An interchangeable wearable jewelry as set forth in claim 2, wherein said resilient insert is Nylon.

4. An interchangeable wearable jewelry as set forth in claim 3, wherein said non-tarnishing metal is a metal selected from the group consisting of stainless steel, titanium, siladium, hard gold alloy and platinum.

5. An interchangeable wearable jewelry as set forth in claim 2, wherein said base unit contains a multiple number of said receiving structures for receiving a multiple number of said feature units.

6. An interchangeable ornamental article as set forth in claim 1, further including said different base unit wherein said feature unit includes a gemstone, said base unit is a finger ring and said different base unit is a pendant.

* * * * *